US008043173B2

(12) United States Patent
Menalagha et al.

(10) Patent No.: US 8,043,173 B2
(45) Date of Patent: Oct. 25, 2011

(54) SPORTS TRAINING SYSTEM

(76) Inventors: Nasrin Menalagha, Chicago, IL (US); Srini Nunna, Chicago, IL (US); Mir S. Rahim, Skoki, IL (US)

( * ) Notice: Subject to any disclaimer, the term of this patent is extended or adjusted under 35 U.S.C. 154(b) by 46 days.

(21) Appl. No.: 12/693,518

(22) Filed: Jan. 26, 2010

(65) Prior Publication Data

US 2011/0183783 A1 Jul. 28, 2011

(51) Int. Cl.
*A63B 69/00* (2006.01)
*A63B 69/38* (2006.01)

(52) U.S. Cl. ..... 473/464; 473/450; 473/458

(58) Field of Classification Search ..... 473/464, 473/458, 450, 207–209, 266, 212–217, 269, 473/274–277; 362/103; 36/136
See application file for complete search history.

(56) References Cited

U.S. PATENT DOCUMENTS 4,660,829 A * 4/1987 Whiteneir ..... 473/63
4,665,388 A * 5/1987 Ivie et al. ..... 340/573.1
4,848,009 A * 7/1989 Rodgers ..... 36/137
4,869,509 A * 9/1989 Lee ..... 473/209
5,158,089 A * 10/1992 Swezey et al. ..... 600/595
5,221,088 A * 6/1993 McTeigue et al. ..... 473/201
5,300,921 A * 4/1994 Hoch et al. ..... 340/573.6
5,343,445 A 8/1994 Cherdak
5,354,050 A * 10/1994 McCarthy ..... 473/458
5,437,289 A * 8/1995 Liverance et al. ..... 600/592
5,452,269 A 9/1995 Cherdak
5,530,626 A 6/1996 Norment
5,592,759 A 1/1997 Cox
5,619,186 A 4/1997 Schmidt et al.
5,700,205 A 12/1997 Sanford
5,800,278 A * 9/1998 Varriano ..... 473/209
5,913,838 A 6/1999 Reilly
6,001,023 A * 12/1999 Sanchez et al. ..... 473/217
6,238,056 B1 * 5/2001 Rapisarda ..... 362/103
6,270,432 B1 8/2001 Matlock
6,315,571 B1 11/2001 Lee
6,673,027 B2 * 1/2004 Fischer ..... 600/595
6,730,047 B2 * 5/2004 Socci et al. ..... 600/595
7,033,281 B2 * 4/2006 Carnahan et al. ..... 473/221
7,096,607 B2 * 8/2006 Guzman ..... 36/137
7,152,345 B2 12/2006 Koenig
7,771,293 B1 * 8/2010 Vann ..... 473/422
7,854,668 B2 * 12/2010 Shelton ..... 473/450
2004/0130887 A1 * 7/2004 Wei ..... 362/103
2009/0042674 A1 * 2/2009 Shelton ..... 473/450
2009/0298621 A1 * 12/2009 Moye ..... 473/450
2010/0138971 A1 * 6/2010 McVeigh et al. ..... 2/22
2010/0273585 A1 * 10/2010 Vann ..... 473/450

* cited by examiner

*Primary Examiner* — Raleigh W. Chiu
(74) *Attorney, Agent, or Firm* — Clifford Kraft

(57) ABSTRACT

A training system used in sports or other training that where a participant wears a device with a visual indicator such as a device emitting colored light and an optional signaling device like a vibrator or beeper. The device can be worn on the head, elbow, wrist, waist, knee, ankle or foot or be part of an participant's attire. The device can optionally be embedded in or on a shoe. A motion or position sensor can cause the visual indicator to change color or indication when the wearer is not moving correctly. Also, in some embodiments, a vibration can signal can be commanded by a coach or instructor to show that the player is not properly moving. An embedded processor can optionally set up various rhythm patterns used in practice. The device, wherever it is worn or disposed, can optionally be controlled remotely by a coach or instructor using a wireless transmission such as digital or analog radio or light to establish certain rhythms or to signal certain participants. The coach can send different signals to different devices worn by different participants. In a particular shoe embodiment, each of a pair of shoes can optionally communicate with the other member of the pair wirelessly so that a processor in one of the shoes can coordinate a rhythm pattern of vibration or beeping signals between the shoes.

19 Claims, 12 Drawing Sheets

SPORTS TRAINING SYSTEM

FIELD OF THE INVENTION

The present invention relates generally to sports training devices and more particularly to a sports training behavior modification system with devices such as ankle bands, head bands, shoes or other worn attire that can present a visual color or make other presentations when particular movements are being made, and present a different color or presentation when they are not being made or they are being made incorrectly. The system can be commanded by an instructor to vibrate or otherwise signal a player who is not moving correctly.

DESCRIPTION OF THE PRIOR ART

Athletes participating in most sports are required to move their feet, their arms or other parts of their bodies, or otherwise hold or move parts of their body in particular ways. This is particularly true in a sport like tennis or Cardio Tennis™ where the player should keep the feet in continual movement. Coaches have a particularly difficult time training players, especially newer players, to keep the feet moving. It would be advantageous to have a system including devices that could be worn by participants during training such as a shoe, a band or other attire that could signal that a particular foot movement, or other body behavior, is not taking place or should have taken place. This system should also allow the coach or trainer to direct the movement and hence change behavior. In addition, a visual display that the player is moving wrong (or not moving) would make the player stand out among other players and hence tend to cause self-correction.

Vibration devices and alarms have been used in shoes in the art. Matlock in U.S. Pat. No. 6,270,432 teaches a tennis training shoe that contains a removable alarm that alarms when the heel touches the ground. This shoe can be used for tennis training to alert the player not to rest the heel on the ground. This device gives no visual indication of proper movement.

In U.S. Pat. No. 6,315,571, Lee teaches a training slipper that can be used to teach children to dance. This slipper can buzz or play music and can be instructed by an instructor to signal to the dancer. Pairs of slippers or shoes can communicate with each other wirelessly.

Cherdak in U.S. Pat. Nos. 5,343,445 and 5,452,269 teaches an athletic shoe that includes a timing device for measuring the amount of time the shoe is off the ground in the air.

Schmidt et al. in U.S. Pat. No. 5,619,186 teaches a foot weight alarm that signals when too much weight is being put on a single foot. This invention can be used with patients recovering from hip and knee replacements.

Norment in U.S. Pat. No. 5,530,626 teaches an athletic shoe that can generate and broadcast an audible signal in the form of music or a message.

Cox in U.S. Pat. No. 5,592,759 teaches vibrating footwear using a vibrating assembly. Cox's shoe is generally used for providing a foot massage. Koenig in U.S. Pat. No. 7,152,345 also teaches a therapeutic vibrating shoe that can be used with tired, achy feet. Reilly in U.S. Pat. No. 5,913,838 teaches a vibrating foot pad or insole apparatus.

Rodgers in U.S. Pat. No. 4,848,009 teaches flashing footwear that are provided with a battery and light source such that the light comes on for a predetermined interval when the foot is placed down. After the predetermined interval, the light shuts off. This causes the shoe or device to flash when the wearer walks.

None of the prior art devices provide a method where a coach can train a participant or player to move a certain way such as left, right, forward and backward, or train the player to keep the feet or other body parts moving or in a particular position that allows self-correction. It would be advantageous to have a sports training device that could visually indicate that a player is not moving correctly so that the player would be motivated to self-correct, and that could be remotely commanded by an instructor to signal the player when the foot or other body part should be moved or correctly placed if not self-corrected.

SUMMARY OF THE INVENTION

The present invention relates to system including a visual indicator and an optional player signaling device in a ankle brace, wrist band, shoe, knee band or brace, head band, elbow band or waist band or other attire, worn or attached. The indicator can be a panel with light sources like LEDs that change color when the player is not moving, or moving improperly or any other type of indicator. For example, the device might display blue on any participant who is moving correctly and yellow or red on participants who are not. The signaling device can be generally controlled by the instructor and can be a vibrator, an alarm such as a beeper, or any other signaling device. The instructor can cause vibrations or beeps to particularly chosen players to aid them to keep moving or to show them the proper rhythm. The system can be used in any sport for training, and it can be associated with any type of apparel such as a shoe, wrist band, knee band or brace, waist band, socks or headband or other attire. The present invention can be used for training athletes or participants in any sport to achieve behavior modification during training to improve technique for the particular sport and obtain optimum performance. The devices of the present system can be controlled locally by a sensor, an embedded processor, or remotely controlled by a coach or trainer.

The present invention also finds application in diverse areas such as military group training programs and the like, to train soldiers to follow an instructor's orders. Here, visual indicators show who is moving correctly and who is not; the instructor can send signals to any individual group member, subgroup, or to the entire group. The present invention also finds application in such diverse sports training as swimming, horse racing jockey training, boxing, volleyball, football, down-hill skiing, skating, track event, baseball, and any other individual or group training where body movement or placement is important. In addition, the present invention finds application in dance training such as: ballet posture training, Salsa and Tango dancing to follow the beat and maintain proper body posture, as well as yoga for breathing and posture discipline, cheerleading for footwork and posture discipline, tap dancing and any other dances or dance training.

The technique eventually leads a trainee to develop muscle memory or habit to keep the feet or other parts of the body in motion or in the correct position. In tennis, the trainee develops the habit of keeping the feet in motion, quick reactions, running to the shot and an early racket preparation. This is especially true in cardio or aerobics tennis where the feet are kept constantly in motion allowing a sustained higher heart rate which improves cardio vascular endurance, fitness and overall performance.

In a particular embodiment of the invention, a sensor can be positioned in a shoe that senses motion. As long as the feet are in motion, a visual indicator shows a particular color (such as blue). If the participant stops moving, the sensor can cause the visual indicator to show a different color (such as yellow).

The instructor can also selectively send a wireless signal to a particular participant to indicate that the player is not moving. Using the vibration or signal, the instructor can also establish a rhythm of foot movement for that player. In another shoe embodiment of the invention, one or both shoes can contain an embedded processor that sets up various rhythm patterns used in practice along with visual indication of lack of movement or wrong movement.

The present invention can be used by coaches or trainers in any sport to correct mechanics particular to that sport such as batting stance in baseball (keeping the back elbow up) for example. In particular, the device can be used during cardio tennis classes signaling participants to continually move their feet during class. It can also be used among players during practice sessions to train the feet to stay in motion and eventually develop the muscle memory or habit to keep the feet in motion.

Various embodiments of the present invention can be totally controlled remotely by wireless signal. For example, the device can contain a wireless receiver or transceiver that receives commands from a remote unit worn or held by the coach. This unit can signal the worn device to change color or can cause a vibration or beep upon command. In the case of a device embedded in a shoe, the coach can command each shoe to vibrate or signal when desired through the use of push buttons or other switching devices from a remote unit. With this configuration, the coach can send a buzz or beep command to the particular shoe indicating to the player that that particular foot should be moved. The coach can set up a rhythm for the player if desired. Different types of beeps or vibrations can signal that the desired movement is forward, backward, left or right or what ever movement or position applies to a particular sport.

In another embodiment, each of a pair of shoes can communicate with the other member of the pair wirelessly so that a processor in one of the shoes can coordinate a rhythm pattern of vibration or beeping signals between the shoes.

It is an object of the present invention to improve the quality of sport training and the learning process which will eventually lead to optimum performance.

It is another object of the present invention to provide a training system that leads to self-correcting behavior by presenting a visual indication that other participants can see indicating proper or improper movement.

It is another object of the present invention to provide a training system that is a helper telling the trainees the basic mantra of "move your feet" or arms or whatever part of the body is required for the proper technique for a particular sport or activity.

It is still another object of the present invention to provide a system that allows the coach or trainer to focus and teach other technical aspects of the sport besides simply basic movements.

It is finally an object of the present invention to provide a helper for the trainer that will allow the trainer to do a better job of instruction.

It is important to note, that the present invention can help a player improve without intervention from a coach simply by displaying a different visual indication when the player is not moving right, or not in the right position. This leads to self-correction.

DESCRIPTION OF THE FIGURES

Attention is now directed to several illustrations provided to aid in understanding the features of the present invention.

Several drawings and illustrations have been presented to allow further understanding of the present invention. The scope of the present invention is not limited to what is shown in the figures.

DESCRIPTION OF THE INVENTION

The present invention relates to a sports training system that allows a device worn anywhere on a participant's body such as in or on a shoe, or on a band or brace, to present a visual indication of whether the participant is moving correctly. Optionally, the worn device can signal an athlete through a vibration, beep or other signal to provide a training tool for behavior modification for the particular sport such as foot movement. The devices of the invention can generally be placed in or on a shoe, ankle brace, wrist band, head band, elbow band, waist band or knee brace or band, or anywhere else on the athlete's body. The worn part of the invention can also be clipped to a shoe or other place such as the tongue of the shoe, or the side or back, to the belt or anywhere. Any placement of the worn device is within the scope of the present invention. In particular embodiments, a coach can remotely control movement by sending a radio or other wireless signal from a remote unit to one or more of the worn devices. In other embodiments, an embedded processor can create and control a rhythm or control the visual indication. In some shoe configurations, a processor in one shoe can control the vibrations or signals in both of the shoes by communicating wirelessly with the other shoe.

Figure 1A:
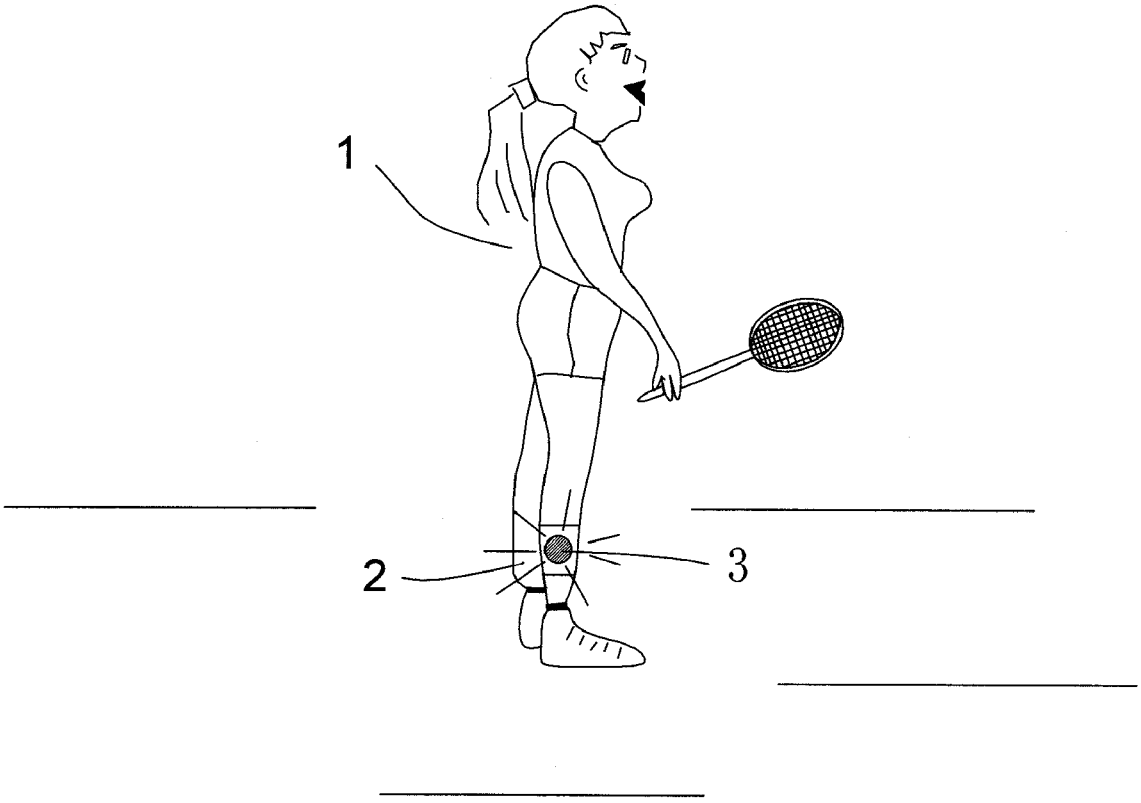
FIG. 1A shows an embodiment of the present invention worn as an ankle band that visually presents a particular color based on movement.

Turning to FIG. 1A, an ankle embodiment of the present invention is seen. A participant or player 1 wears the device 2 and attempts to move according to a particular sport. A visual indicator 3 presents colored light or can beep or otherwise optionally signal. A particular example of the functioning of the present invention is when the motion is continuous or proper, the visual indicator becomes blue or puts out blue light, and when the motion stops or is wrong turns a different color puts out a different color light such as yellow or red.

Figure 1B:
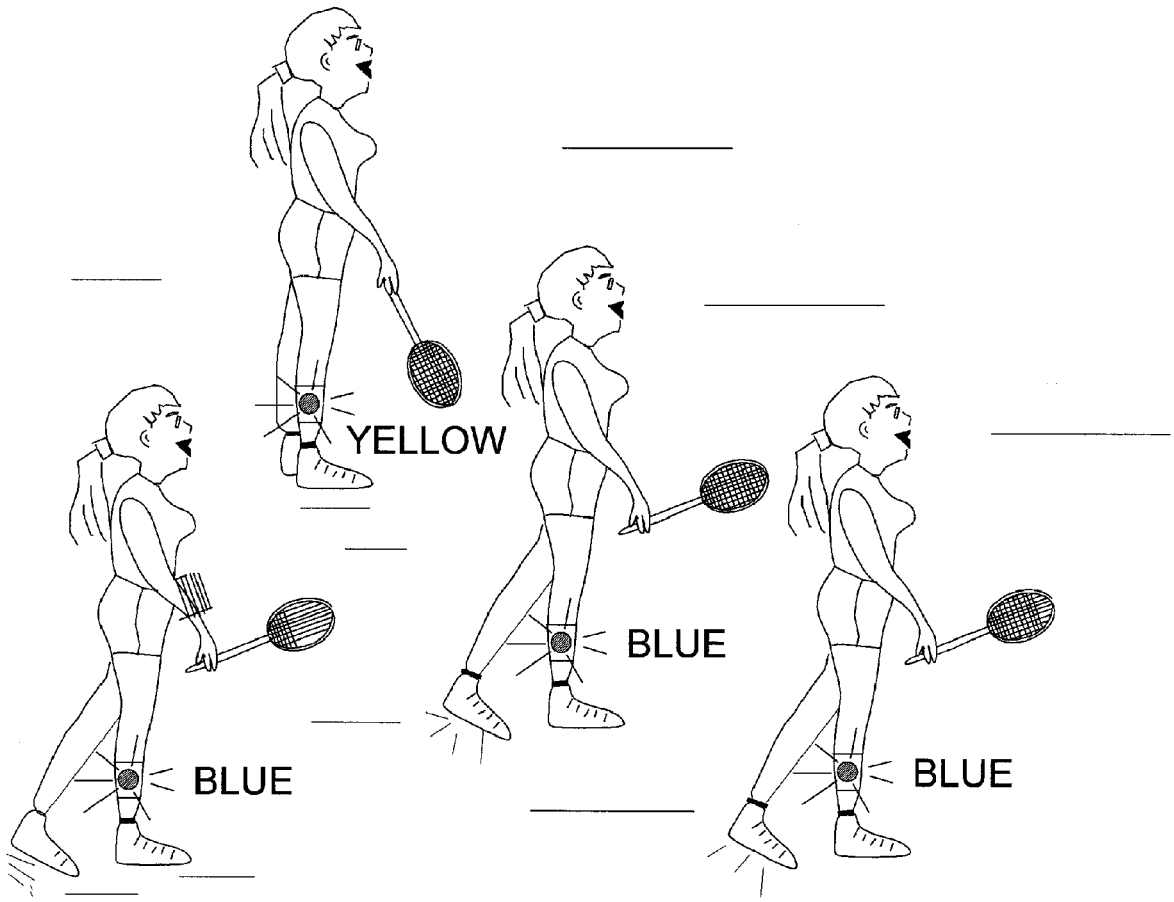
FIG. 1B shows a group of participants with ankle devices in a practice session. All of the participants are showing blue indicating correct movement except one who is showing yellow indicating incorrect movement.
Figure 2:
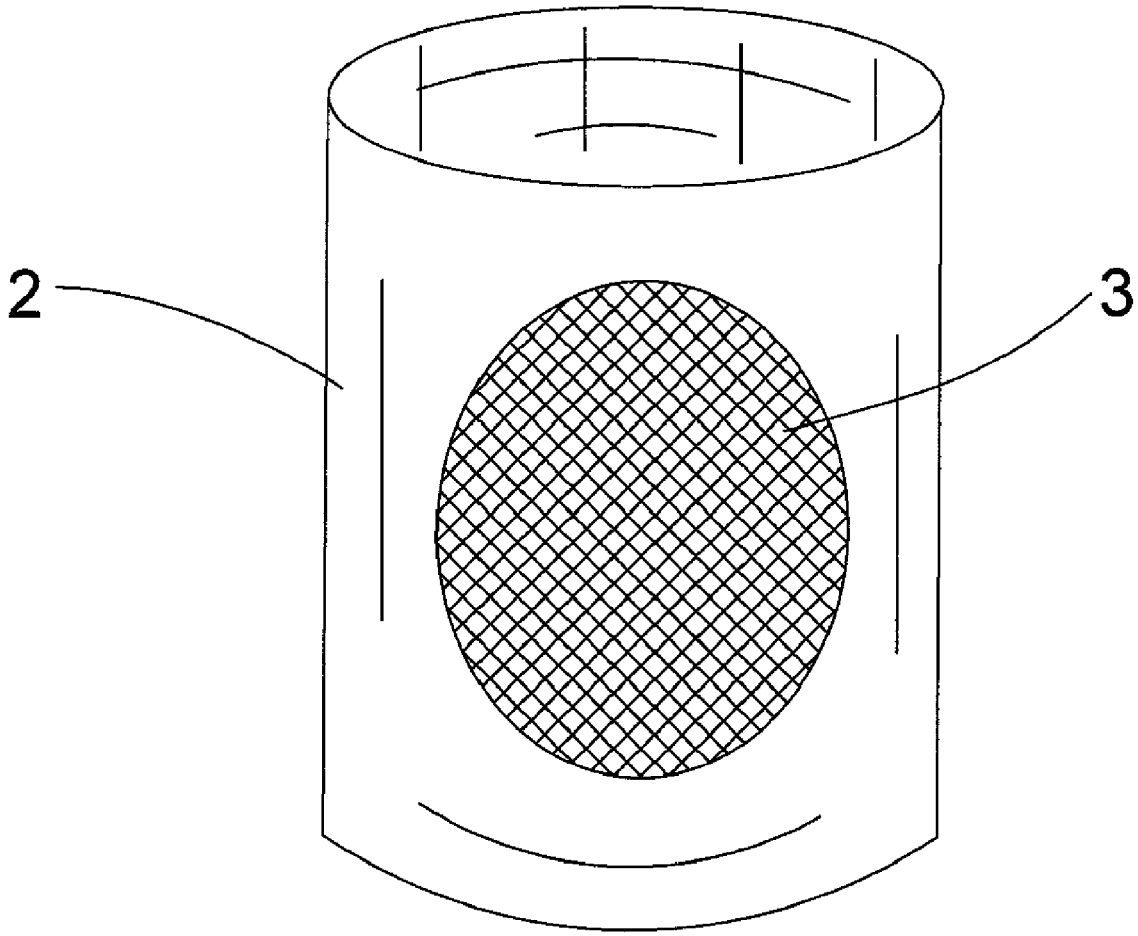
FIG. 2 shows a perspective view of an ankle worn embodiment.

FIG. 1B shows a group of participants wearing ankle embodiments of the invention. All of the players except one are moving correctly and are displaying blue. One player has stopped moving and is displaying yellow. FIG. 2 shows a close-up perspective view of an ankle band embodiment of the invention 2 seen in FIGS. 1A-1B. The visual indicator 3 can be clearly seen.

Figure 3:
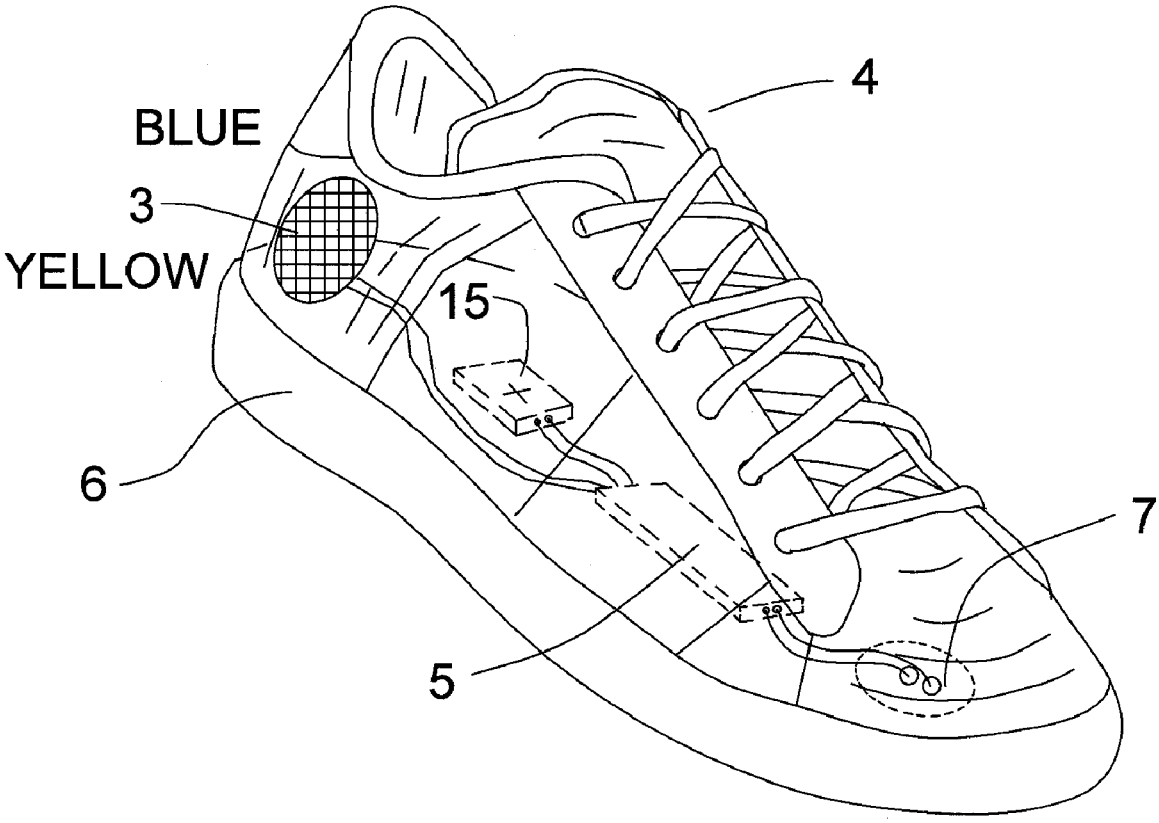
FIG. 3 shows an embodiment of a shoe containing a sensor, visual display, signal unit and battery.

In FIG. 3, a shoe embodiment of the present invention is shown with a shoe 4 incorporating a visual indicator 3, signaling device such as a vibrator 5 in the sole 6 or otherwise embedded in the shoe. A sensor 7 senses acceleration or correct motion. A battery 15 powers both the signaling device 5, the sensor 7, and the visual indicator 3. In a particular mode, correct motion causes the visual indicator 3 to display blue, while no motion, or incorrect motion, causes the visual indicator to display yellow (any color combinations are within the scope of the present invention). Also, in an optional mode, when the player's foot contacts the ground a short signal pulse such as a vibration can tell the player of that fact. The preferred method is to use a short pulse, since a continuous vibration or signal might be distracting in some sports. The embodiment of FIG. 3 can be used in one shoe or be duplicated in a pair of shoes.

Figure 4:
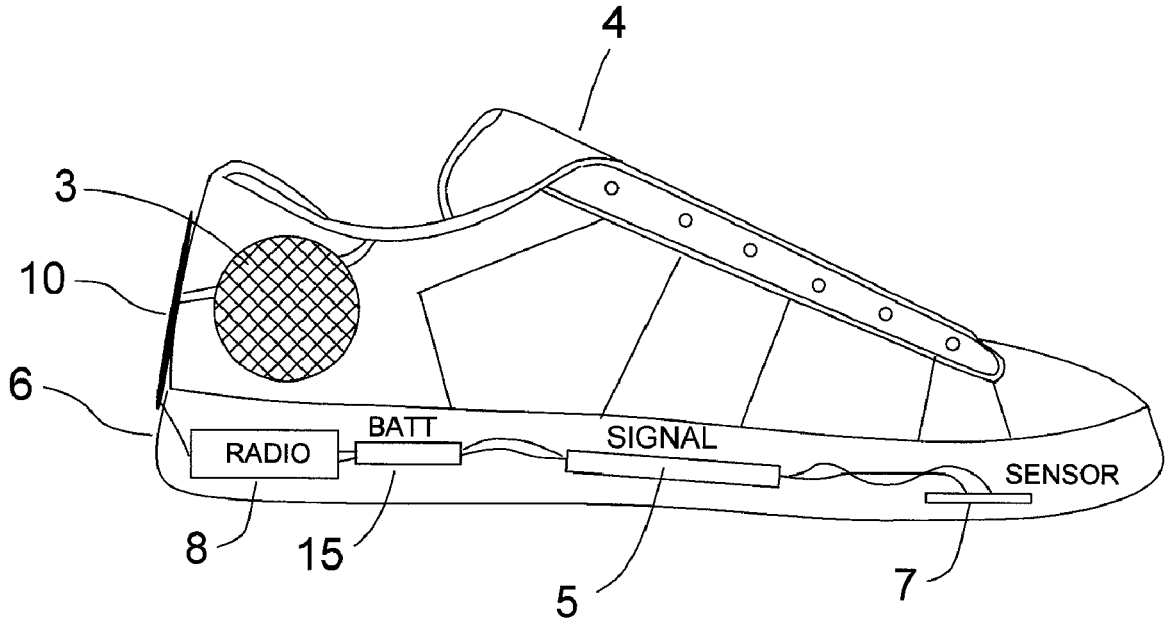
FIG. 4 shows a side view of the embodiment of FIG. 3

FIG. 4 shows a side view of the embodiment of FIG. 3 with the internal components in the sole 6 shown, namely the signaling device 5, the sensor 7, a radio unit 8, a radio antenna 10, a visual indicator 3 and a battery 15. While the antenna 10 is shown mounted on the rear of the shoe, it can be mounted anywhere. A preferred antenna is a small metal strip, or a small metal plate with a slot. An alternate mounting location for the antenna 10 is flat in the sole. Generally, radio antennas perform better when they are mounted above the ground and not directly upon it. Therefore, the preferred mounting location for the antenna 10 is either on the back of the device on the top of it. It should be noted that while radio is the preferred mode of remote wireless communication, any wireless technique such as visible or invisible light or sound can also be used and is within the scope of the present invention. The embodiment of FIG. 4 can be driven by wireless signals from a remote unit worn or held by a coach to establish a rhythm pattern or signal incorrect movement or lack of movement. It can also be driven from a personal computer or any other device with a wireless interface.

Figure 5:
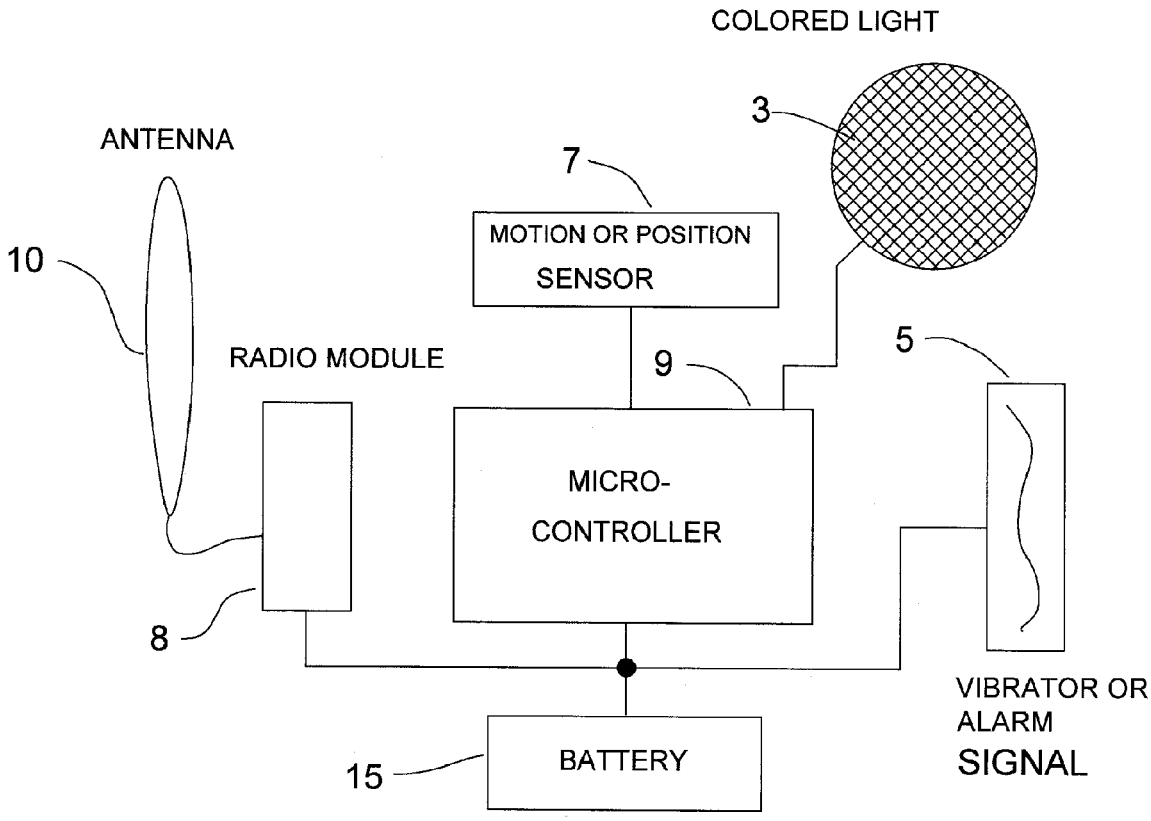
FIG. 5 shows a block diagram of a worn unit with a microcontroller, visual indicator, signal unit, pressure sensor, battery, radio module and antenna.
Figure 11:
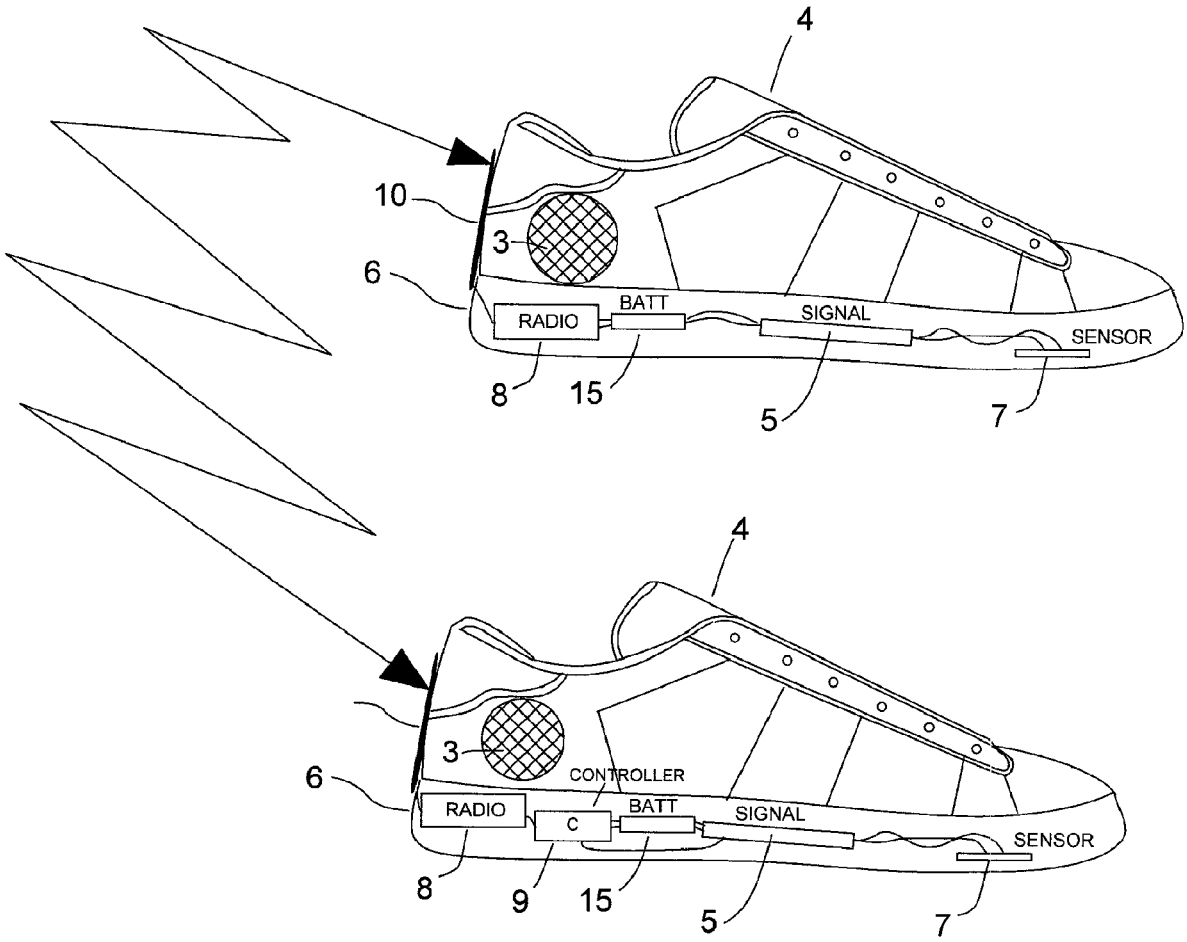
FIG. 11 shows one shoe controlling rhythm on a pair of shoes.

The worn devices of the of the present invention can contain a controller 9 (shown in FIGS. 5 and 11). This can be a standard micro-controller or microprocessor or any other type of processor known in the art. The controller can drive the visual indicator 3, and/or the signaling device 5 using pre-stored patterns established for training in a particular sport or by receiving commands from an instructor having a remote command unit. While the controller 9 can be any type of processor, a preferred controller can be a simple 16 bit microcontroller similar to those manufactured by Motorola Corp. Generally, the controller contains a memory device as well as a processor with a stored program that runs on the processor. It should be noted that while some of the figures show embodiments of the present invention in a shoe or pair of shoes, as stated, the device can be worn or disposed anywhere on the participant's body.

FIG. 5 shows a block diagram of a worn unit containing a microcontroller 9 (that contains a memory device and stored program) in communication with a vibrator or signaling device 5, a radio module 8 and a motion or position sensor 7, and a visual indicator 3. The radio module 8 can be electrically connected to an antenna 10 for short range wireless radio communications such as short range digital radio communications like BLUETOOTH. The microcontroller 9 can receive an incoming signal from the radio module 8 that activates a stored rhythm, or a signal that causes a single beep or vibration from the signaling device 5. The radio module can be substituted with an infrared light receiver or other wireless device. Any type of wireless communication is within the scope of the present invention. The controller 9 can also optionally be commanded from a remote location to switch to a mode where the signaling device 5 or the visual indicator 3 is activated and controlled by the motion or position sensor 7. A motion sensor can be a simple accelerometer, while a position sensor can function electronically like a standard liquid/bubble level know in the art of carpentry. A pressure sensor can also be used to determine, for example, when a shoe is in contact with the ground. These combinations allow a full range of different training rhythms, patterns or responses to be activated for particular training in a certain sport.

Figure 6:
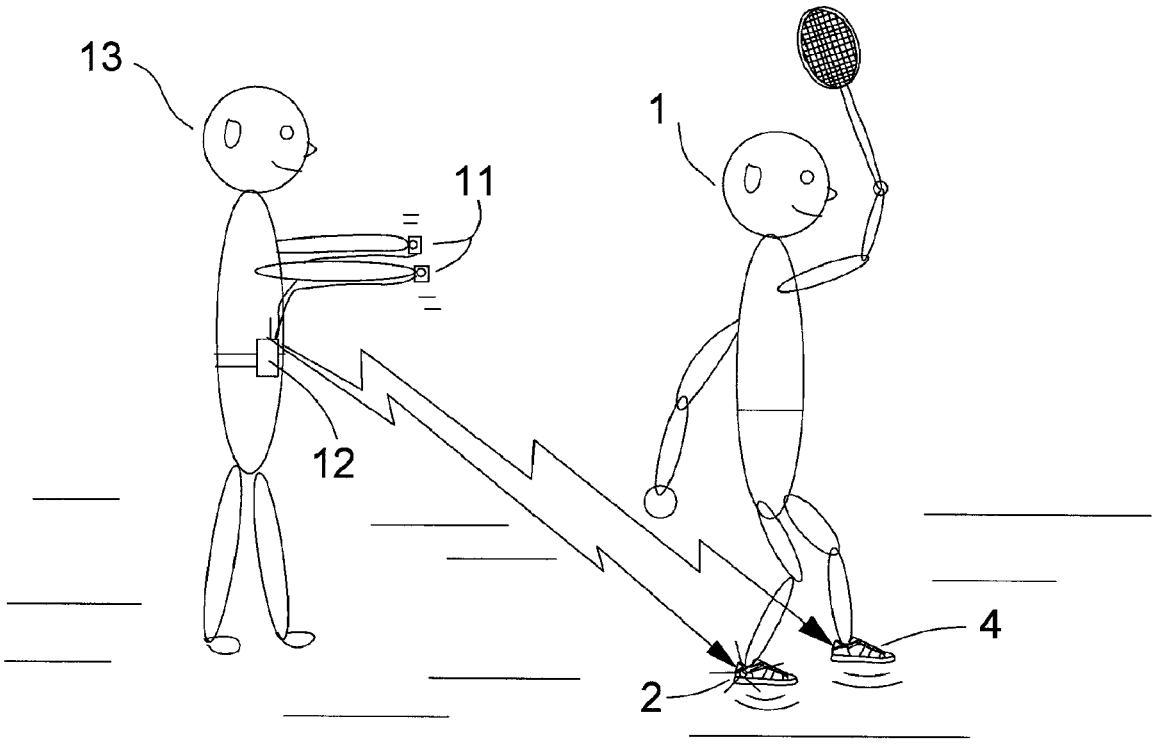
FIG. 6 shows a shoe embodiment of the invention being used in a direct training mode by an instructor

FIG. 6 shows a particular mode of operation of a shoe embodiment of the present invention. A coach 13 wears or carries a wireless transmitter or transceiver 12 that has one or two buttons 11 that the coach 13 can control by hand or otherwise. A participant in training 1 wears one or more of the shoes 4 previously described. The radio transmitter 12 communicates directly with the shoes 4 causing a beep or vibration in a particular shoe when the coach 13 pushes a particular button 11. In this way, a training rhythm can be established where the player 1 learns to move the feet properly. In other embodiments of the present invention, a similar rhythm can be set up in the player's shoes 4 or where ever the device is worn by the player by a program stored and executed in a microcontroller as previously mentioned.

Figure 7:
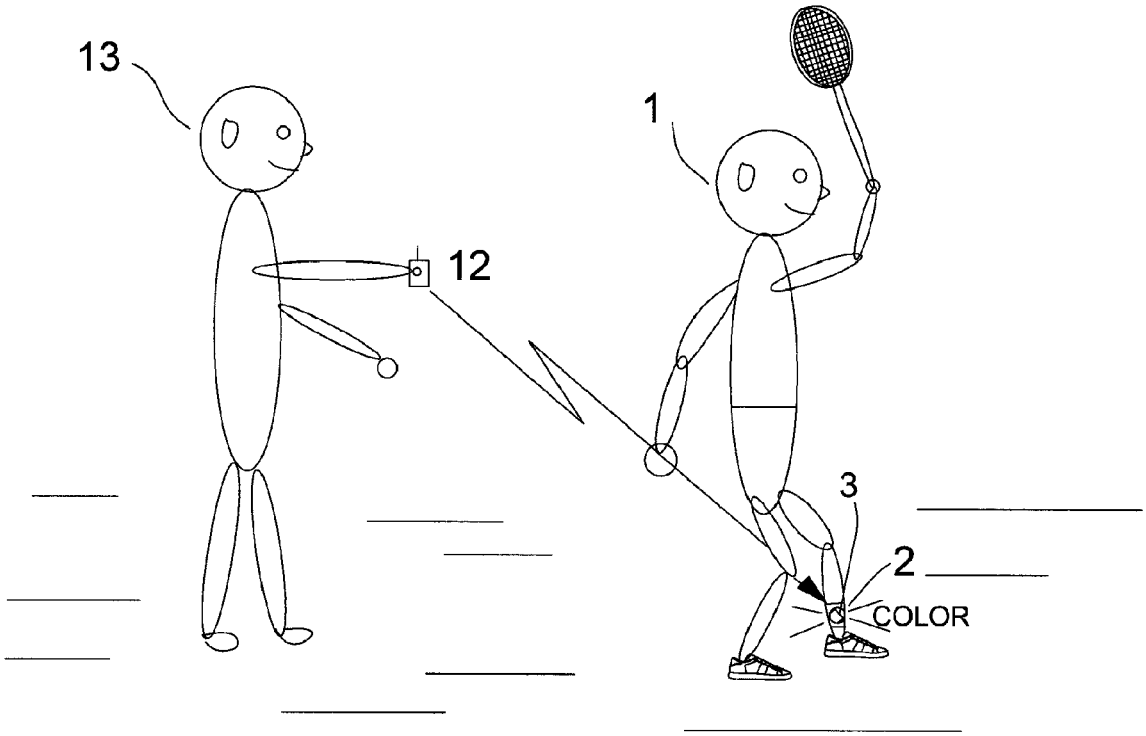
FIG. 7 shows a shoe embodiment being used in a controlled visual display mode.

FIG. 7 shows a similar arrangement; however, here the coach or instructor 13 sets or controls the color or output of the visual display 3 on the device 2 worn by the player. In a slightly different mode, the visual display 3 can work automatically based on position or motion, and the signaling device (beeper or vibrator) can be remotely under control of the instructor 13.

Figure 8:
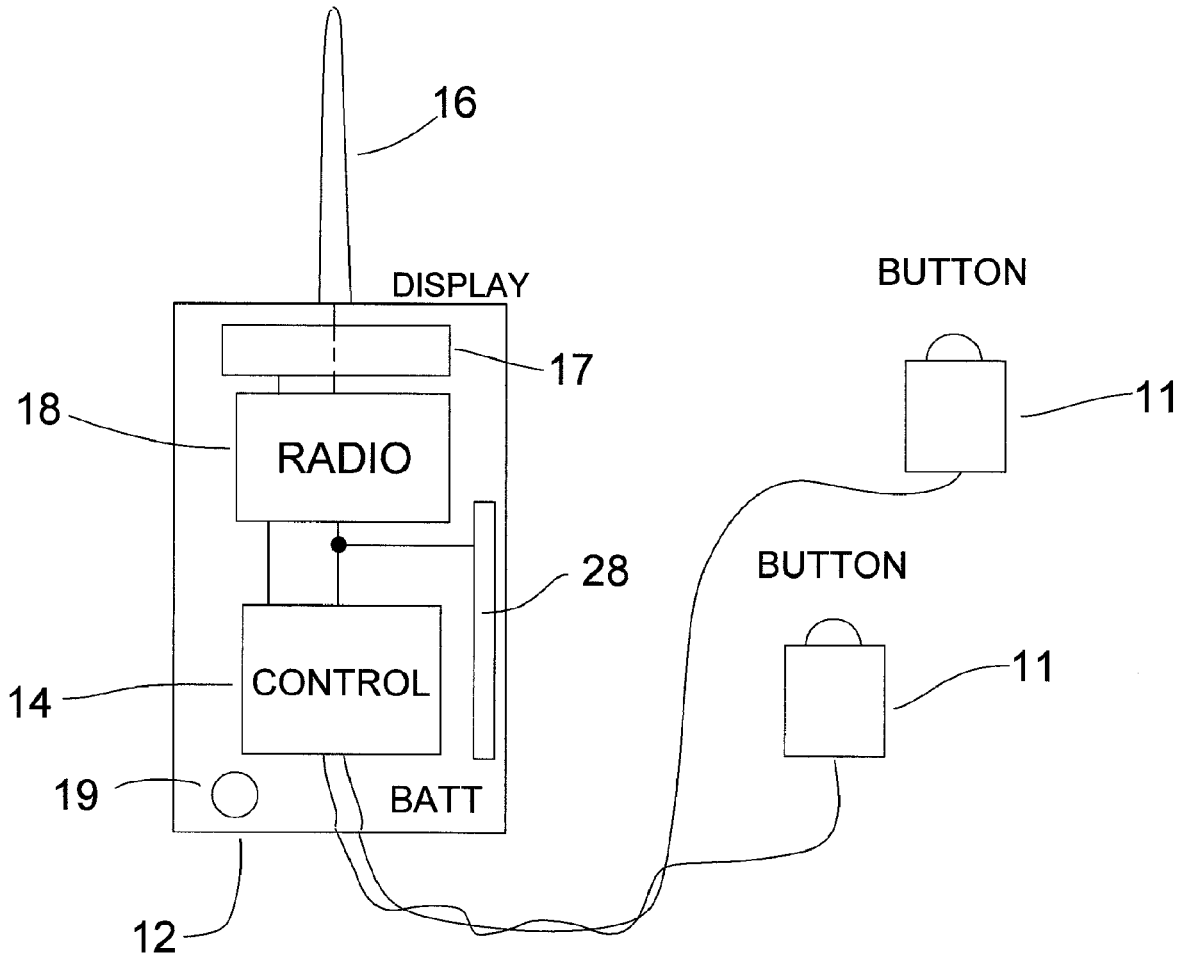
FIG. 8 shows a block diagram of a remote unit worn by a coach or trainer that can be used in the training mode of FIG. 6.

FIG. 8 is a block diagram of an embodiment of a remote transmitter or transceiver 12 held or worn by a coach (as shown in FIG. 6). The remote unit 12 can also contain a second controller 14 or control circuitry as well as a radio module 18. The radio module 18 can be electrically connected to an antenna 16 that can be internal or external to the unit. A battery 28 generally powers the unit 12. An optional display 17 and optional keypad (not shown) or buttons 27 (shown on FIG. 10) can allow the coach to choose different modes of operation or transmit different instructions to the shoes. Optional buttons 11 can be electrically attached to the remote unit 12 for establishing rhythms that are hand-controller by the coach. These buttons 11 can plug into the remote unit 12 by electrical methods known in the art or can be wireless. As stated, while digital radio is the preferred wireless technique; however any wireless method is within the scope of the present invention such as analog radio, light, sound or any other wireless technique. A particular example of a preferred communication technique is a low power digital radio standard known in the art as BLUETOOTH.

Figure 9:
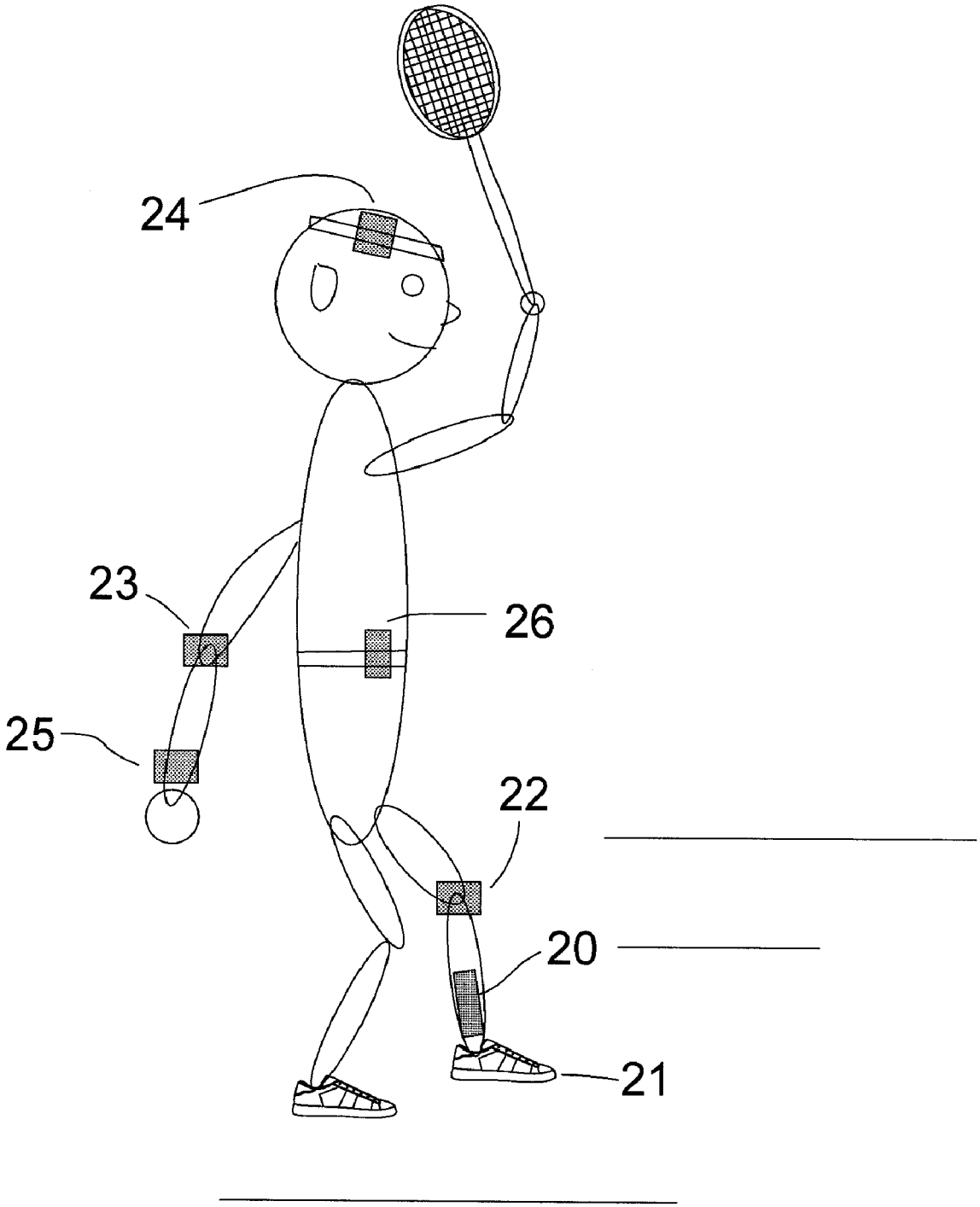
FIG. 9 shows a diagram of several of the possible places the devices of the present system can be worn by a participant.

FIG. 9 shows some of the different locations where the worn device of the present invention can be disposed or worn on the athlete's body, namely the head 24, the wrist 25, the waist 26, the ankle 20, the foot 21, the knee 22 or the elbow 23. Wearing or disposing the device anywhere on the participant's body is within the scope of the present invention. Generally, an participant would only wear the device in one of the locations shown in FIG. 9 at a particular time. The device of the present invention can also be made part of the athlete's clothing.

Figure 10:
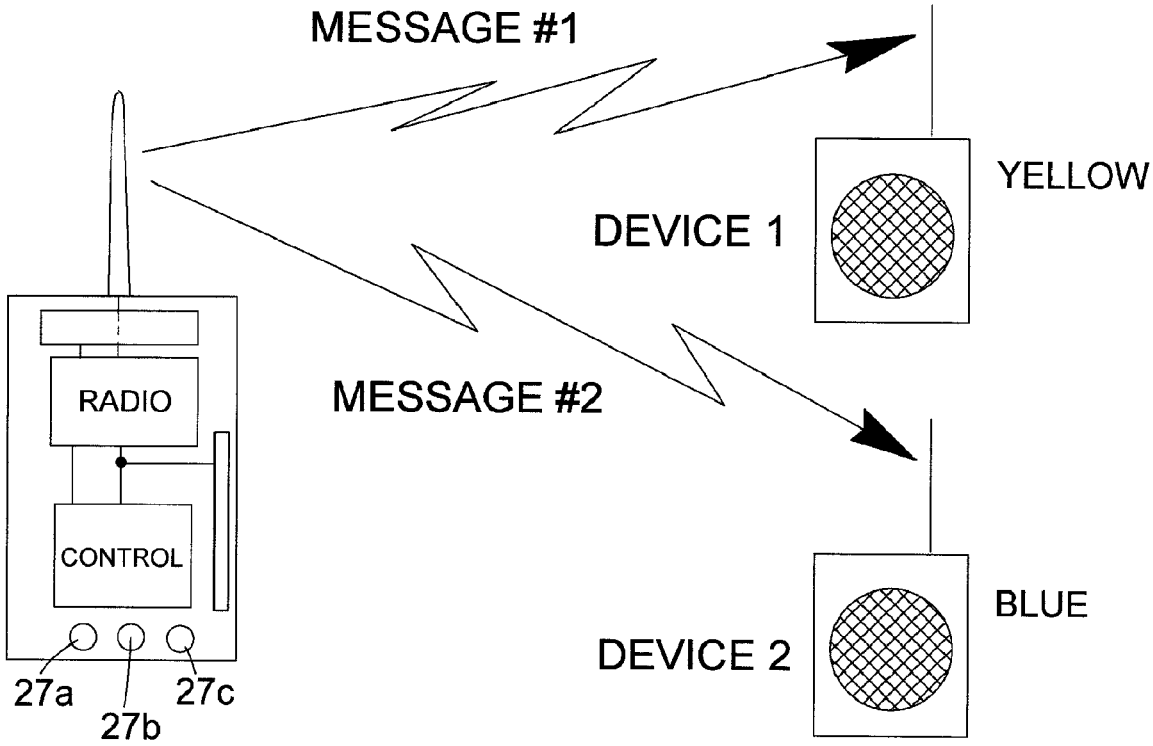
FIG. 10 shows a remote unit sending different messages to two different device units in the system.

In some embodiments of the present invention, an instructor may want to send a signal to one (or a sub-group) of worn units (people being trained). This can be easily done by selecting a particular unit's address by using a button on the instructor's remote unit. The remote unit can then send an addressed wireless message that is only decoded and acted upon by the particular unit addressed. The address can be stored in a message header or the transmitter can send different codes or transmit on different frequencies to different participants. Any method or technique for routing or transmitting a message to a particular receiver in a group of receivers is within the scope of the present invention. In this way, for example, a particular soldier or dancer in a group can be signaled without distracting or signaling the other soldiers or dancers. This is shown in FIG. 10 where the remote unit by selecting one of a plurality of buttons 27*a*, 27*b* . . . 27*c*, the instructor can cause a particular device to change color (visual presentation), or to vibrate or beep.

FIG. 11 shows an alternate mode of operation of a shoe embodiment of the present invention where one shoe contains a controller 9, and the other does not. Both shoes 4 contain radio or other wireless modules 8 as well as signaling or vibration devices 5, and/or visual indicators 3. The shoe with the controller 8 can send a wireless signal to the other shoe also controlling its signal device. In this manner, the controller 8 in one shoe, by using a stored program, can establish a rhythm for both shoes. The one controller 8 can therefore control both shoes. Each shoe can have an optional sensor 7 for operation in any of the previous modes.

The preferred signaling device for those embodiments having a signaling device is a miniature vibrator that is found in a variety of devices on the market. Usually some sort of vibrating member is disposed in proximity to a small motor that activates the member. A vibrating member can be a flat metal plate (or any other rigid material). Usually a rotating arm mechanically attached to the motor drives a protrusion or cam on the plate to cause vibration. While a vibrator is a preferred signaling device, a beeper, light or any other type of signaling device is within the scope of the present invention.

A preferred sensor for embodiments having a sensor can be a simple solid state pressure sensor, acceleration sensor or position sensor known in the art.

In various embodiments of the present invention, the components may be disposed anywhere in the device or in any juxtaposition. In particular, in shoe embodiments, the components can be in a single module or disposed in the sole of the shoe (or elsewhere) as shown in some of the figures.

The preferred visual indicator can be a panel of LEDs or similar light emitting devices. Any color indicator or light emitting device is within the scope of the present invention. Colors can be blue, yellow, red or any other color or combination of colors to signal different conditions.

It should be noted that while the preferred embodiments generally display a first color or visual indication with correct motion or position, and a second color or visual indication with incorrect motion, it is possible to operate the present invention in modes where no visual indication is made until the motion or position is wrong, or visual indication stops when the motion or position is wrong. In other words in an off-on mode rather than a change of presentation mode.

Several descriptions and illustrations have been presented to aid in understanding the features of the present invention. One skilled in the art will realize that numerous changes and variations are possible without departing from the spirit of the invention. Each of these changes and variations is within the scope of the present invention.

We claim:

1. A sports training system comprising:

a device adapted to be worn by a participant that includes a visual indicator and a motion or position sensor;

a signaling device;

wherein said motion or position sensor causes said visual indicator or said signaling device to make a different visual presentation or signal when a predetermined motion or position is not being maintained.

2. The sports training system of the claim 1 wherein said visual indicator displays a plurality of different colors.

3. The sports training system of claim 1 further comprising a remote unit in wireless communication with said device, wherein said remote unit can command said visual indicator to change visual indication.

4. The sports training system of claim 3 wherein said wireless communication is radio.

5. The sports training system of claim 1 further comprising a remote unit in wireless communication with said device, wherein said remote unit can command said signaling device to signal.

6. The sports training system of claim 5 wherein said wireless communication is radio.

7. The sports training system of claim 1 wherein said signaling device is a vibrator.

8. The sports training system of claim 1 wherein said device is embedded in or worn on a shoe.

9. The sports training system of claim 1 wherein said device can be worn on a participant's head, wrist, elbow, waist, knee, ankle or foot.

10. A sports training system comprising, in combination:

a device adapted to be worn by a participant that includes a visual indicator, a motion or position sensor, a signaling device and a wireless receiver;

wherein, said motion or position sensor causes said visual indicator to make a different visual presentation when a predetermined motion or position is not being maintained;

and wherein, a wireless signal from a remote command unit received by said wireless receiver can cause said signaling device to signal.

11. The sports training system of claim 10 wherein said visual indicator displays a plurality of different colors.

12. The sports training system of claim 10 wherein said remote unit can command said visual indicator to change visual indication.

13. The sports training system of claim 10 wherein said signaling device is a vibrator.

14. The sports training system of claim 10 wherein said wireless signal is a radio signal.

15. The sports training system of claim 10 wherein said wireless signal is a light signal.

16. A method of sports training comprising:

providing a worn device with a visual indicator and a signaling device said worn device having a position or motion sensor;

causing said visual indicator to change visual indication in response to said position or motion sensor;

providing a wireless receiver in said worn device wherein a wireless signal from a remote location can cause said signaling device to signal.

17. The method of claim 16 wherein said wireless signal is a radio signal.

18. The method of claim 16 wherein visual indicator presents a plurality of colors.

19. The method of claim 16 wherein said position or motion detector causes said visual indicator to present a first color corresponding to a first motion or position and a second color corresponding to a second motion or position.

* * * * *